US010081965B2

(12) United States Patent
Warner

(10) Patent No.: US 10,081,965 B2
(45) Date of Patent: Sep. 25, 2018

(54) MODULAR HYPERBOLIC TRAPEZOID FABRIC STRUCTURE

(71) Applicant: 0798555 B.C. LTD., Surrey (CA)

(72) Inventor: Gerhard Allan Warner, Surrey (CA)

(73) Assignee: 0798555 B.C. LTD., Surrey (CA)

( * ) Notice: Subject to any disclaimer, the term of this patent is extended or adjusted under 35 U.S.C. 154(b) by 0 days.

(21) Appl. No.: 15/552,432

(22) PCT Filed: Feb. 19, 2016

(86) PCT No.: PCT/CA2016/050164

§ 371 (c)(1),
(2) Date: Aug. 21, 2017

(87) PCT Pub. No.: WO2016/131152

PCT Pub. Date: Aug. 25, 2016

(65) Prior Publication Data

US 2018/0044938 A1 Feb. 15, 2018

(30) Foreign Application Priority Data

Feb. 20, 2015 (CA) ..... 2882541

(51) Int. Cl.
*E04H 15/46* (2006.01)
*E04H 15/18* (2006.01)
*E04B 7/10* (2006.01)

(52) U.S. Cl.
CPC ..... *E04H 15/46* (2013.01); *E04B 7/102* (2013.01); *E04H 15/18* (2013.01)

(58) Field of Classification Search
CPC ..... E04H 15/18; E04H 15/322; E04H 15/34; E04H 15/46; E04B 7/102
(Continued)

(56) References Cited

U.S. PATENT DOCUMENTS 1,214,979 A * 2/1917 Von Ahnen ..... E04H 15/003 135/114
2,928,405 A * 3/1960 Lawson ..... E04H 15/003 135/118
(Continued)

FOREIGN PATENT DOCUMENTS

CA 2790239 A1 * 8/2010 ..... E04H 15/34
CA 2731430 A1 * 8/2011 ..... E04B 1/342
(Continued)

OTHER PUBLICATIONS

International Search Report (ISR) dated May 3, 2016 in PCT/CA2016/050164.
(Continued)

*Primary Examiner* — Robert Canfield

(57) ABSTRACT

The present invention relates to fabric structures and methods for erecting same. The structure of the invention includes two telescoping apex legs, two generally vertical base legs having a base adapted to resist upward force on the base leg, four roof beams and a fabric roof membrane connected to each of the roof beams along a substantial portion of its periphery. A moment is applied tending to bow the roof beams upward and outward and the roof membrane is held under tension counter to said moment when the apex legs are telescopically raised relative to the base legs and the apex and base legs are positioned vertically. The invention provides a structure with a hyperbolic trapezoid roof made from modular components that are readily transported and assembled.

19 Claims, 10 Drawing Sheets

(58) Field of Classification Search
USPC ..... 52/63, 80.2, 222; 135/97, 141, 157, 158, 135/160
See application file for complete search history.

(56) References Cited

U.S. PATENT DOCUMENTS 2,963,031 A 12/1960 Carrol
3,060,949 A * 10/1962 Moss ..... E04H 15/18 135/115
3,092,932 A 6/1963 Wilson
3,232,806 A * 2/1966 Widmer ..... B29C 33/0011 156/212
3,394,720 A * 7/1968 Moss ..... E04H 15/003 135/118
3,757,478 A * 9/1973 Pryor ..... E04B 7/102 52/80.2
3,810,481 A * 5/1974 Nohmura ..... E04H 15/04 135/120.3
5,234,011 A * 8/1993 Lynch ..... E04H 15/322 135/114
5,477,876 A * 12/1995 Moss ..... E04H 15/26 135/100
5,566,701 A * 10/1996 Grey ..... E04H 15/58 135/135
5,622,197 A 4/1997 Valaire
5,918,614 A * 7/1999 Lynch ..... E04H 15/18 135/114
6,055,999 A * 5/2000 Grey ..... E04H 15/322 135/143
7,219,681 B1 * 5/2007 Hamilton-Jones .... E04H 15/322 135/119
D746,041 S * 12/2015 Lin ..... D3/5
2003/0000563 A1 * 1/2003 Kuperman ..... E04H 15/40 135/121
2003/0034061 A1 * 2/2003 Warner ..... E04H 15/18 135/144
2007/0062567 A1 * 3/2007 Warner ..... E04H 15/18 135/97
2009/0308424 A1 * 12/2009 Danziger ..... E04H 15/48 135/141

FOREIGN PATENT DOCUMENTS

CA 2882541 * 6/2015
CA 2623411 C 9/2015
CA 2731430 C 3/2017
EP 0 346 236 A2 * 12/1989
EP 346236 A2 12/1989
FR 2865486 A1 6/2005
WO 8700230 A1 1/1987
WO 2010011649 A1 1/2010
WO 2010094103 A1 8/2010

OTHER PUBLICATIONS

Written Opinion (WO) dated May 3, 2016 in PCT/CA2016/050164.
International Preliminary Report on Patentability (IPRP) dated Aug. 22, 2017 in PCT/CA2016/050164.
Examiner's Report dated Dec. 9, 2015 in related CA 2,882,541.
Examiner's Report dated Jul. 29, 2015 in related CA 2,882,541.

* cited by examiner

MODULAR HYPERBOLIC TRAPEZOID FABRIC STRUCTURE

CROSS-REFERENCE TO RELATED APPLICATION

This application is a national filing of International Application No. PCT/CA2016/050164, filed on Feb. 19, 2016, entitled "MODULAR HYPERBOLIC TRAPEZOID FABRIC STRUCTURE," having as inventor Gerhard Allan Warner, which claims the benefit of, and priority from, Canadian Patent Application No. 2,882,541, filed Feb. 20, 2015, entitled "MODULAR HYPERBOLIC TRAPEZOID FABRIC STRUCTURE," having as inventor Gerhard Allan Warner.

FIELD OF THE INVENTION

The invention relates to fabric structures and methods for erecting same.

BACKGROUND

Fabric structures are used in many applications ranging from one person tents to venues designed for holding events for hundreds or thousands of people with stages, displays, exhibitions, etc. Structural integrity, protection from the elements, portability, water drainage, and safety in variegated conditions of use are significant concerns.

The inventor of the present application has filed patent applications for fabric structure systems in the past that teach novel fabric structures and other elements of the applicant's popular SaddleSpan™ and Matrix-Marquee™ tents, including use of keder rails and keder strips for attaching fabric membranes to other membranes when forming fabric structures (see CPA 2623411; 2731430; and 2790239). However, there remains a need for additional versatile, aesthetic, structurally sound, modular fabric structures.

Hyperbolic paraboloid roof shapes are advantageous due to aesthetic appeal and functionality, including inherent structural and drainage advantages. While various prior designs for fabric structures teach hyperbolic trapezoid roof structure, for instance Carroll in U.S. Pat. No. 2,963,031 teaches a structure having a locking system for tensioning a hyperbolic paraboloid fabric membrane roof, there remains a need for a versatile system for erecting such structures of different sizes for different applications.

In the present application, the inventor provides a fabric structure having two telescoping apex legs and two shorter base legs connected by four beams having a fabric membrane attached to them to form a tensioned hyperbolic trapezoid fabric roof. The legs, beams and fabric membrane may be assembled for erection and disassembled for transport. Fabric wall membranes are provided that may be conveniently tensioned for aesthetic appeal and structural integrity. Keder rails formed on legs, beams or added purlins (used herein to refer generally to horizontal members that may be load bearing or not) are provided to facilitate ease of attachment to and tensioning of fabric membranes. The system allows for relative ease of erection of safe, sound fabric structures of various sizes in many conditions, including indoors without anchors, or outdoors with undulating ground and severe weather conditions.

SUMMARY OF THE INVENTION

In an aspect, the invention provides a fabric structure comprising:

a) Two telescoping apex legs each having a bottom end that supports said leg on the ground and a top end having an apex connector for connection of the leg to two beams;

b) Two generally vertical base legs each having a bottom end attached to a base that supports the leg on the ground, the base being adapted to resist upward force on the base leg by its mass, added mass or being anchored to the ground, and a top end having a base connector for connection of the base leg to two beams;

c) Four roof beams each having a first end attached to one of said apex connectors and a second end attached to one of said base connectors to form a support structure;

d) A roof fabric membrane connected to each of said roof beams along a substantial portion of its periphery, and dimensioned to be held under tension when connected to all of said roof beams; and e) Said roof beams being sufficiently rigid and said apex and base connectors are configured such that, when said apex connectors are telescopically raised relative to said base connectors and said apex legs are positioned and maintained generally vertically, a is applied to said roof beams tending to bow them upward and outward.

In another aspect, there is provided a method of erecting a fabric structure described herein, comprising the steps of: attaching said roof fabric membrane to said beams by sliding keder strips on the periphery of said fabric membranes into keder rails on said beams; attaching said beams to said connectors; telescopically raising said apex connectors relative to said base connectors and adjusting the position of said apex legs to form a support structure with a tensioned hyperbolic fabric roof on generally vertical legs; and attaching wall fabric membranes to said support structure by sliding keder strips on the periphery of said fabric membranes into keder rails on said beams, legs and on purlins that releasably attach to the support structure.

In preferred embodiments the corner connectors and/or apex connectors may form a hinged connection with the roof beams and all of the legs may be telescoping legs.

The roof beams may have roof keder rails and keder strips and a substantial portion of the roof fabric membrane's periphery may be slidingly received in the roof keder rails. Further, one or more beams, legs or purlins added to the structure may have keder rails for receiving keder strips on a wall fabric membrane. Preferably, the wall fabric membranes are tensioned when attached to the structure.

In a preferred embodiment, one or more of the legs, beams or purlins of the structure include a sleeve having keder rails configured to slide over and be releasably fixed at a selected position on perforated tube forming part of a leg, beam, purlin or connector.

Fabric structures according to the invention may be joined together along adjacent roof beams with apex legs and base legs aligned, preferably using keder strips on membranes inserted into keder railson adjacent roof beams and/or legs. Purlins, stays and cables may be attached as required for stability and/or to tension fabric membranes.

In one embodiment the apex corner connectors are maintained at about the same horizontal position above the base corner connectors.

Methods providing for ease of erection and assembly of the structure and maintaining tension in fabric roof membranes and wall membranes is also provided.

BRIEF DESCRIPTION OF THE DRAWINGS

These and other features of the invention will become more apparent from the following description in which reference is made to the drawings provided for reason of illustration only, wherein.

DESCRIPTION OF PREFERRED EMBODIMENT

As noted, the present invention relates to a versatile modular fabric structure and method for erection and assembly thereof. Preferred embodiments of the invention are described. As those skilled in the art will understand, the description is exemplary only and modifications may be made to the components and configurations, and generally the steps of erection and details of the fabric structure, while remaining within the scope of the invention claimed.

Figure 1:
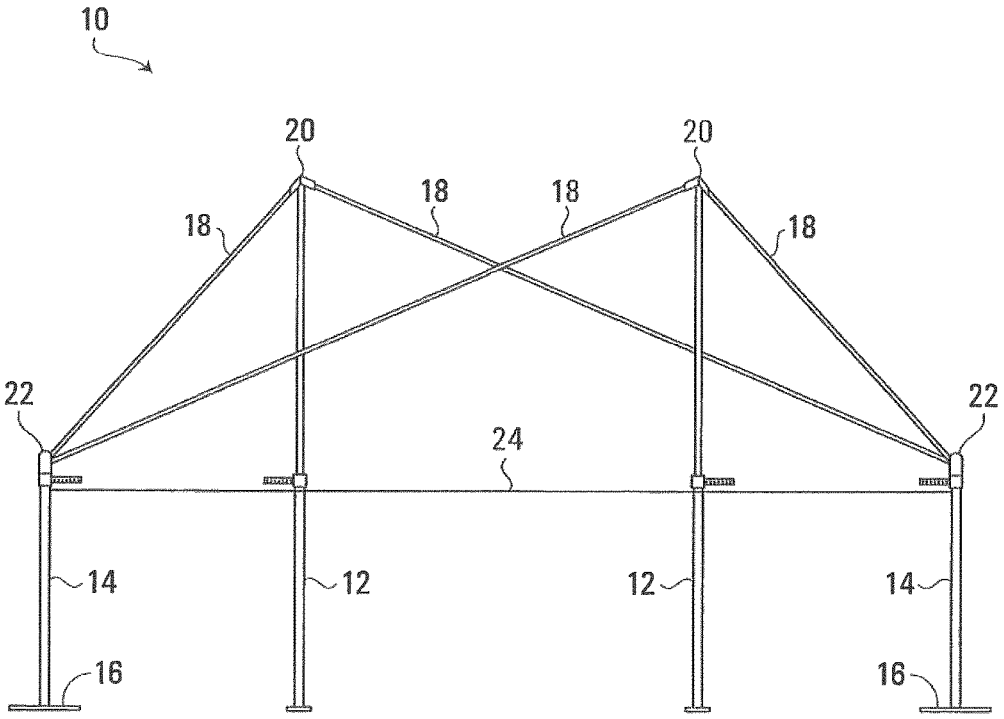
FIG. 1 is a front view of a trapezoidal support structure according to the invention.

An exemplary trapezoidal support structure 10 of an embodiment of the invention is shown in FIG. 1. The structure 10 includes two telescoping apex legs 12, two base legs 14 attached to bases 16 and four roof beams 18. The beams each have a first end attached to an apex connector 20 mounted on said apex legs 12, and a second end attached to a base connector 22 mounted on said base legs 14. A cable 24 may be attached between said base connectors in order to counteract the moment created on the legs due to the configuration of the trapezoidal support structure as discussed further below.

The telescoping apex legs 12 may be formed by any combination of telescoping members formed of material having sufficient strength and rigidity to allow the apex legs to be maintained generally vertical when extended to full height, and to resist forces generated in the assembled structure, and by gravity, wind, precipitation and generally the conditions to be encountered by the fabric structure in use.

Telescoping of the apex legs 12 facilitates raising and lowering of the apex connector 20 relative to the base connector 22. The relative movement changes the angle of the beams 18 relative to the apex connectors 20 and base connectors 22 when the apex and base legs 12, 14 are vertical. The roof beams 18 and connectors 20, 22 are designed to facilitate bowing of the beams 18 to accommodate the change in angle. The resultant moment created in the structure 10 assists with maintaining structural integrity and counteracting forces created by tension in a roof fabric membrane attached to the structure as discussed below. Connectors 20 or 22 may be configured to allow for some angular adjustment of roof beams 18 relative to the apex legs 12 or base legs 14, for instance through hinge means. However, the moment referred to above is present in all preferred embodiments of the invention.

Figure 2A:
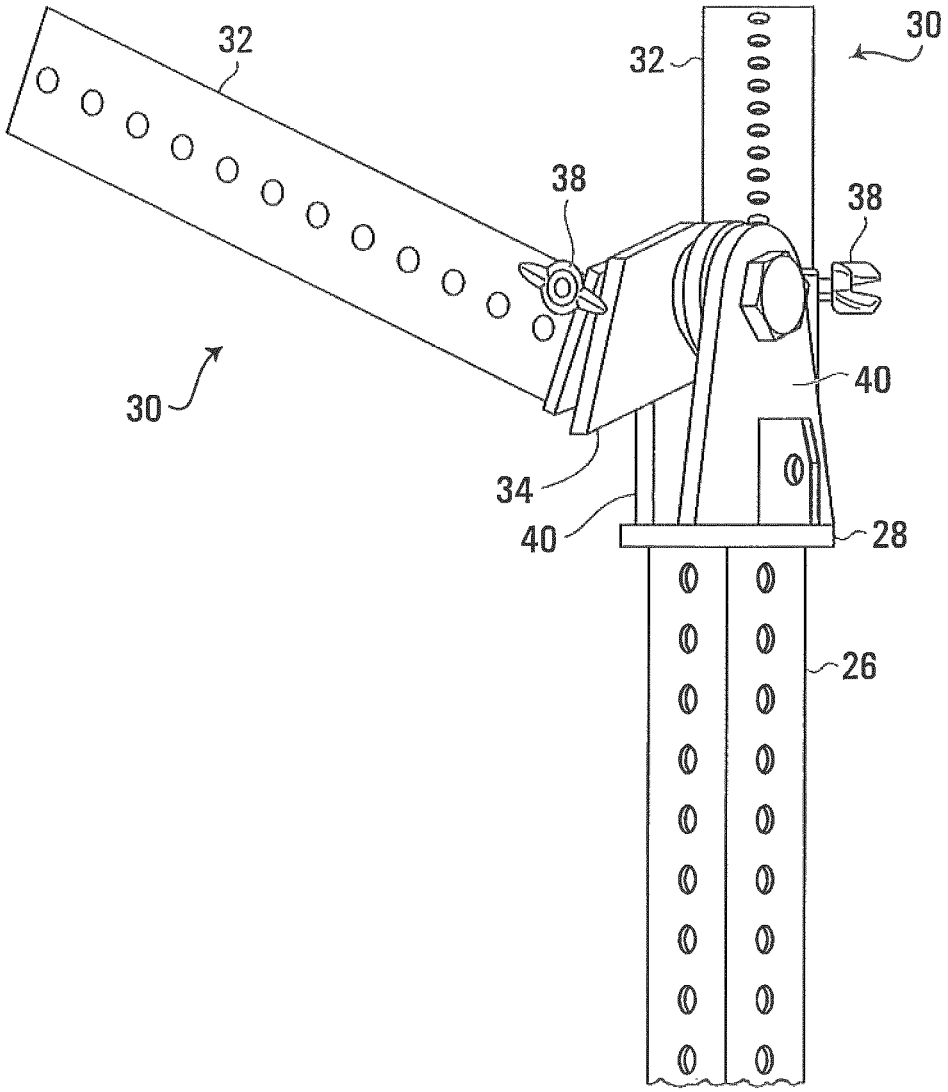
FIG. 2A is a front view of a hinged base connector according to the invention.
Figure 2B:
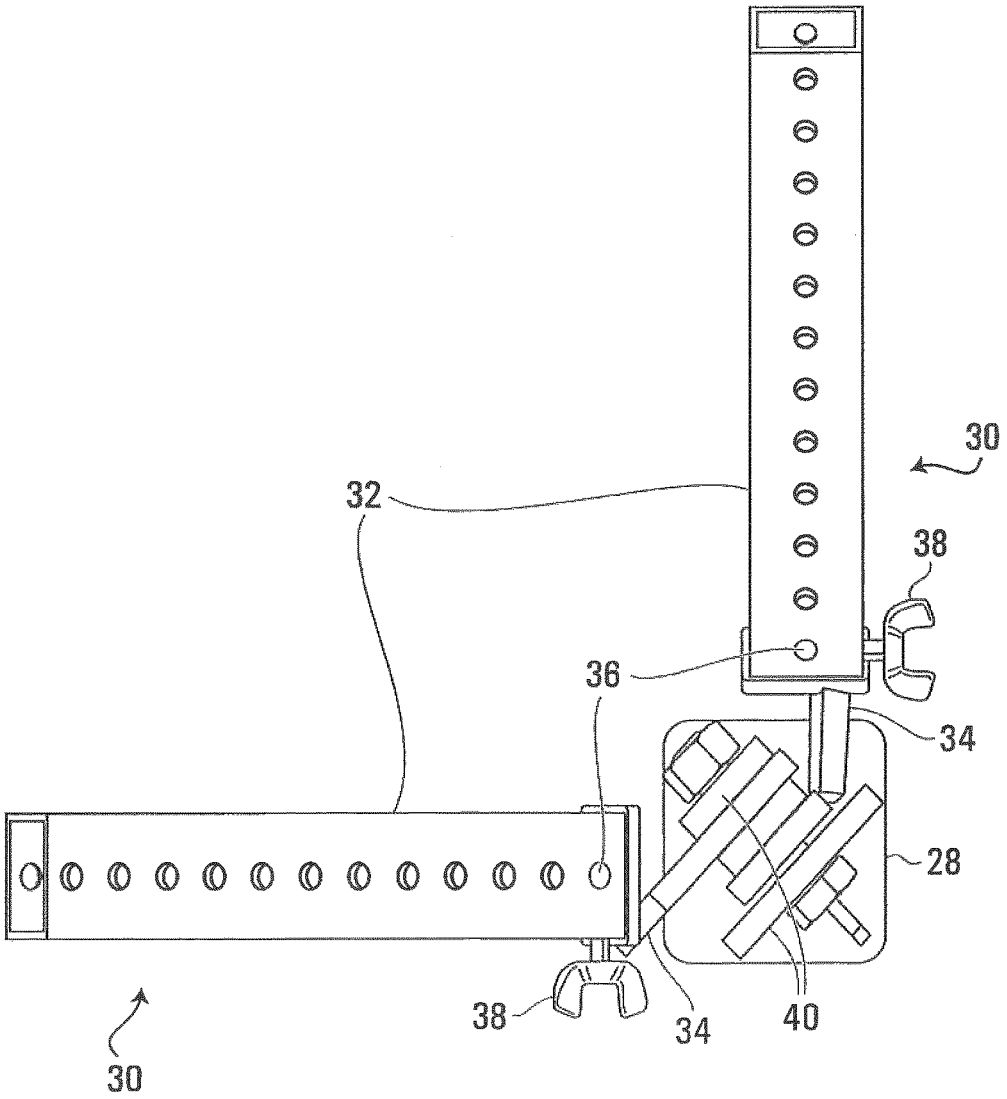
FIG. 2B a top view of a hinged base connector according to the invention.

As shown in FIGS. 2A and 2B, in one embodiment, the base connectors 22 provide a hinged connection to the beams 18. A leg element 26 of the base leg 14 is formed of perforated steel square tube and has a connector element 28 welded to the top thereof. Left and right hinge members 30 include perforated steel square tube beam receiving elements 32 adapted to have ends of said roof beams 18 slide over and be retained thereon. The elements 32 are attached to hinge arms 34 that are formed of bent flat bar steel to provide for orthogonal attachment of the beam receiving elements 32 relative to the base leg element 26. The hinge arms 34 may be attached to the beam receiving hinge elements 32 in any suitable manner. In the embodiment illustrated the beam receiving hinge elements 32 are releasably attached to the hinge arms 34 by threaded rod 36 and bolt and wing nut 38. The hinge arms 34 include a bore hole through the end distant from the beam receiving hinge elements 32 and are bolted between retaining elements 40 formed of flat bar steel welded to the top of the connector element 28 and that have corresponding bore holes. Preferably a double end snap button (not shown) is mounted in the beam receiving hinge elements 32 and positioned for engaging corresponding holes on the roof beams 18 when the beams are received on the beam receiving hinge elements 32. The hinges may include stops for limiting the extent of angular motion.

As those skilled in the art will understand, various configurations of hinges or other connectors may be utilized to provide for angular movement of the roof beams 18 relative to the legs 12 or 14.

Figure 3A:
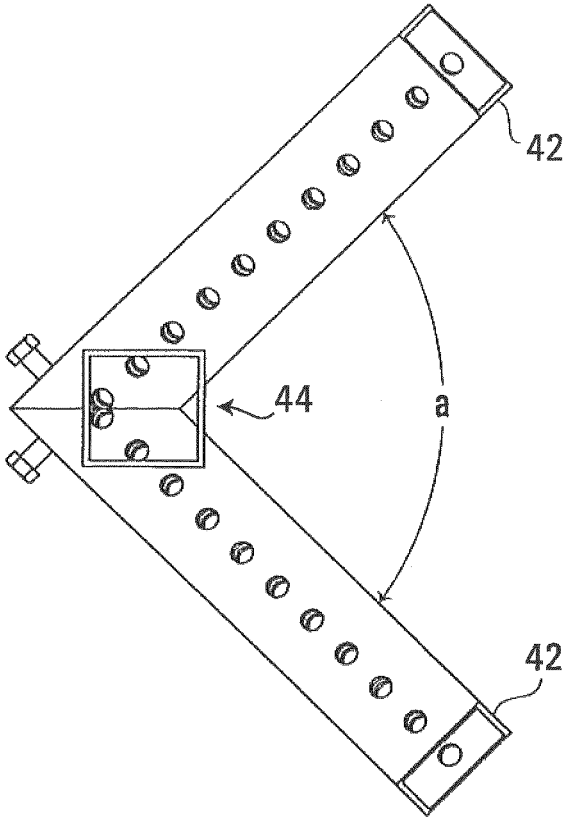
FIG. 3A is a bottom view of an apex connector according to the invention.
Figure 3B:
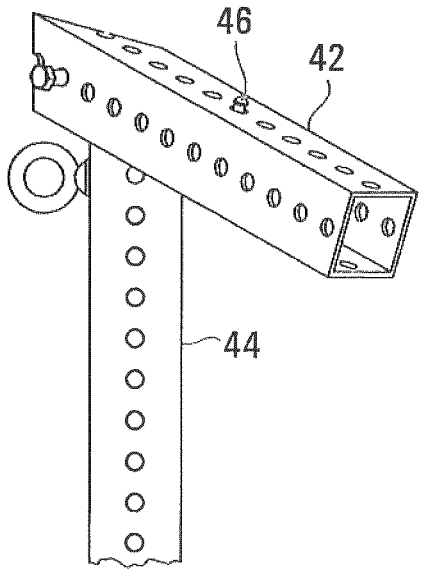
FIG. 3B is side view of a partially assembled apex connector according to the invention.

In one embodiment of the invention, the base connectors 22 are hinged connectors as described and the apex connectors 20 are rigid connectors configured to receive and retain the ends of two beams 18. As shown in FIGS. 3A and B, the apex connector is formed of perforated steel square tube with apex connector elements 42 securely welded to apex leg element 44. The connector elements 42 and beams 18 have flexibility and the arrangement provides for the respective connector elements 42 and beams 18 to be generally orthogonal to each other when the fabric structure is fully erected and assembled. For instance, the angle a on FIG. 3A may be approximately 82 degrees when the apex connectors 20 and base connectors 22 are at the same height, but 90 degrees when the apex connectors 20 are at their desired position relative to the base connectors 22.

Again, a double ended snap button 46 is preferably included in each of the apex connector elements 42. Corresponding holes are included on the roof beams 18 for receiving the snap buttons 46.

Figure 4:
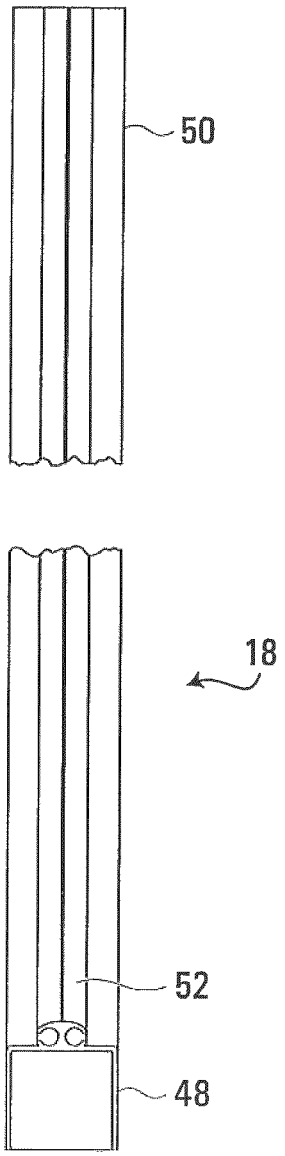
FIG. 4 is a side view of roof beam according to the invention.

The roof beams 18 may be formed of any material having sufficient strength and flexibility to maintain integrity of the fabric structure they are used in. In one embodiment, the roof beams 18 are formed from extruded anodized aluminum. As seen in FIG. 4, beams 18 include a first end 48 adapted to slide over apex connector elements 42 and to be retained there by engagement of the snap buttons 46 in holes in the roof beam 18 (not shown). The roof beams 18 include a second end 50 adapted to slide over the beam receiving hinge elements 32 of the base connector 22 and to be retained there by engagement of snap buttons mounted on said hinge elements 32 in holes on said beam 18 (not shown). The roof beams 18 include a set of two keder rails 52 on each side, each set providing two rails configured to receive keder strips attached to fabric membranes or other elements to be attached to the fabric structure As noted, the telescoping apex legs 12 may be formed with telescoping perforated tubes. In that case, sections of tube of corresponding shape having different perimeters slidingly engage and the height of the leg may be maintained by inserting a locking element through aligned holes in the perforated tubes. However, those skilled in the art will understand that any arrangement of telescopic members having sufficient strength to be maintained in a generally vertical orientation when the telescoping apex legs 12 are in their fully extended position and the fabric structure of the invention is fully erected and assembled may be used.

Figure 5A:
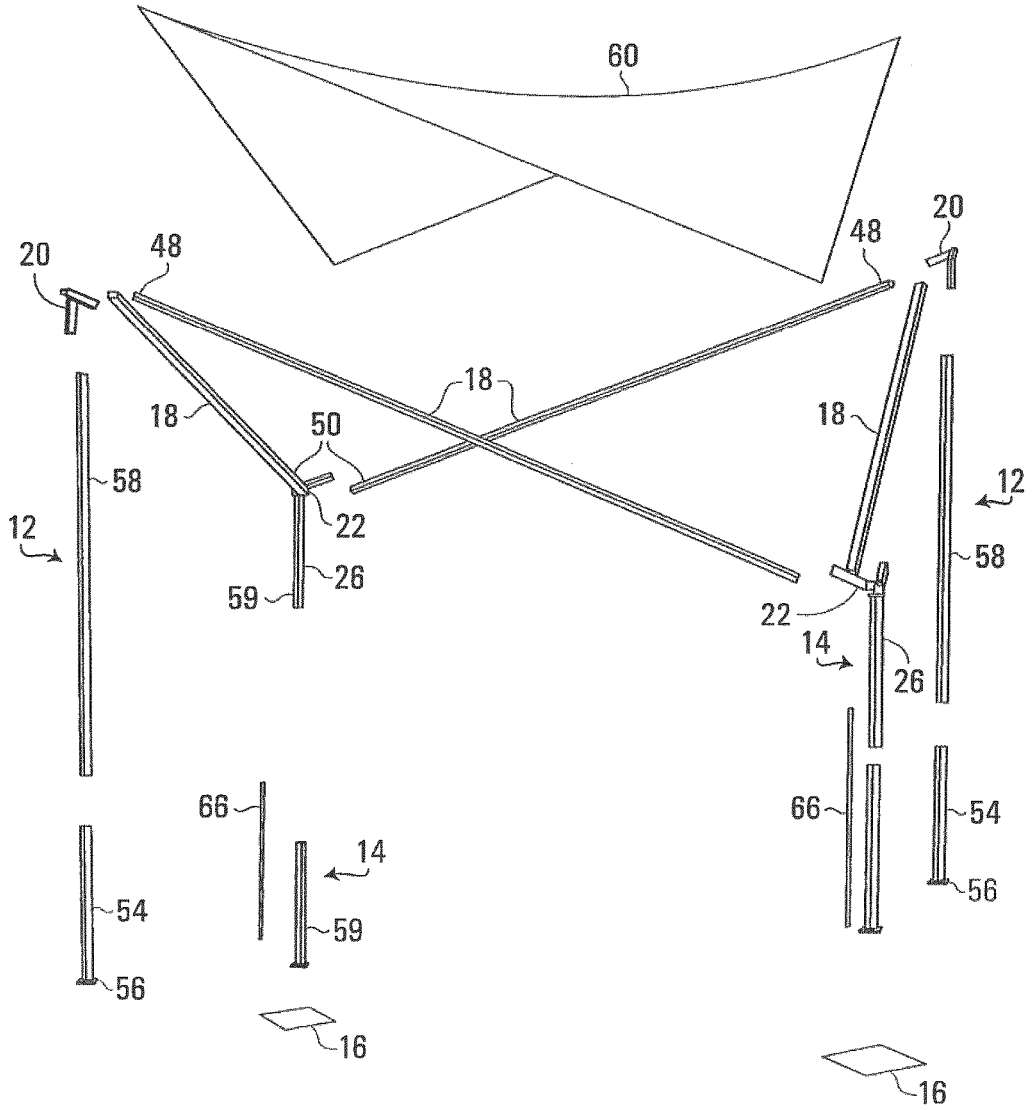
FIG. 5A is an exploded view of a fabric structure according to the invention.
Figure 5B:
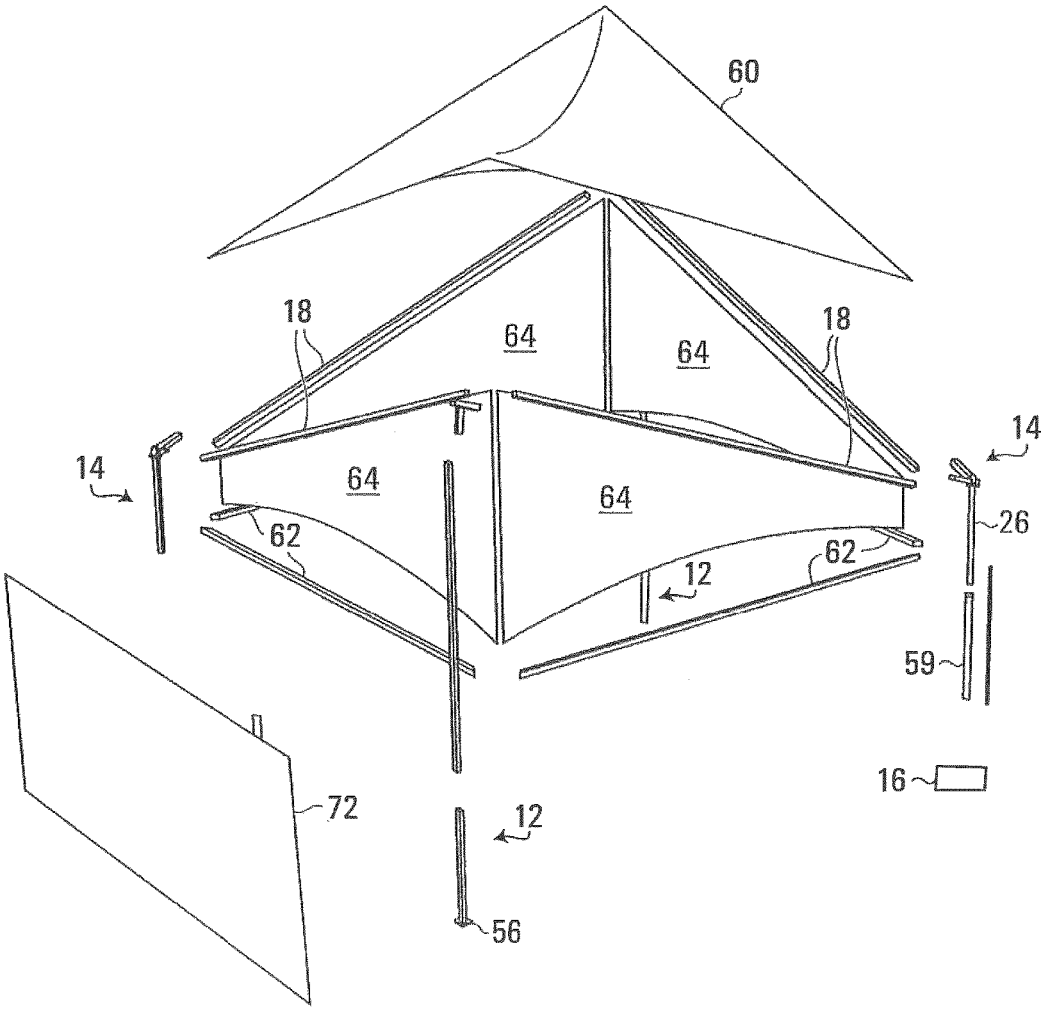
FIG. 5B is an exploded view of a fabric structure having gable and base walls according to the invention.

In the embodiment shown in FIGS. 5*a* and 5*b*, the telescoping apex legs have a perforated steel square tube member 54 having a foot pad 56 affixed thereto and a sleeve 58 dimensioned to slide over member 54. Holes in the sleeve 58 may be aligned with holes in the member 54 for receiving a pin or bolt to retain the relative positioning of member 54 and sleeve 58. Similarly, the apex leg element 44 of connector 20 may be received in the sleeve 58 and fixed by insertion of a pin or a bolt through corresponding holes in those elements. In one embodiment, the sleeve is formed of extruded aluminum and may advantageously be extruded in the same shape as the beams 18, but any material having suitable physical characteristics for the intended use may be used.

When the fabric structure is being erected, keder strips around the periphery of the roof fabric membrane 60 are slid into one of the keder rails 52 on one or more of the beams 18.

The ends 48, 50 of each beam 18 is slid onto a beam receiving hinge element 32 of base connector 22 and apex connector element 42 of apex connector 20 while the apex legs 12 are in a lowered position. The fabric membrane 60 will be attached to the beams 18 in the most convenient manner for the particular application, including with respect to selection of optimum keder rails 52. The attachment of the membrane 60 to the final beam 18 to be attached to the structure will generally be completed by sliding the selected keder rail 52 over the keder strip on the last side of the membrane 60 prior to attachment of the final beam 18 to connectors 20, 22.

Once the beams 18 are all attached to the respective beam receiving hinge elements 32 and apex connector elements 42, the apex legs are telescopically raised and the position of the apex legs 12 adjusted to form the final trapezoid support structure 10 with a hyperbolic trapezoid fabric roof membrane 60 attached. The base leg bases 16 are anchored or have weight added to retain the position and verticality of the base legs 14 on the ground before raising the apex connectors 20 by telescoping the apex legs 12. The apex legs 12 are then adjusted to a final generally vertical orientation and anchored or otherwise restrained as required to retain the position of the apex legs 12 on the ground. Adjustment of the position of the apex legs 12 creates an upward and outward moment on the beams 18.

The fabric membrane 60 is dimensioned so as to be under tension when keder strips on all four sides of the roof fabric membrane 60 are engaged in keder rails on all four of the beams 18 attached to the structure 10. The moment on the beams 18 resulting from adjustment of the apex legs 12 is opposite to the force exerted by tension of the fabric membrane 60 when held in the keder rails 52 of the beams 18. That moment accordingly assists in maintaining tension in the fabric membrane 60. Further, the fabric membrane 60 may be pretensioned when initially affixed to the beams 18 in the support structure 10 and the moment created on the beams 18 by adjustment of the apex legs 12 will be counteracted to some extent thereby tending to straighten the beams 18 in the fully erected fabric structure.

The base legs 14 may be telescoping and may be formed in a similar fashion to the telescoping apex legs 12. In one embodiment, the base legs include a base leg element 59 adapted to receive the base leg element 26 of the base connector 22. Again, the telescoping perforated square tube members may be adjusted to various heights where holes in the perforated steel are aligned and a pin or a bolt used to retain the leg 14 at a set height.

Structural reinforcing elements may be added as required for the particular application. Means will preferably be provided to resist the moment created at the base connectors 22 by the beams after the apex leg 12 is adjusted, such as the cable 24 running between the two base connectors 22 shown in FIG. 1. Similarly, purlins 62 may be affixed between the respective legs to provide additional stability and to assist in retaining gable wall fabric membranes 64 taut in the fabric structure (see FIG. 5*b*).

Gable wall fabric membrane 64 may be attached to the fabric structure 10 using keder strips around the entire periphery of said fabric membrane 64 engaged in keder rails on a beam 18, apex leg 12, base leg 14 and purlin 62.

Figure 6A:
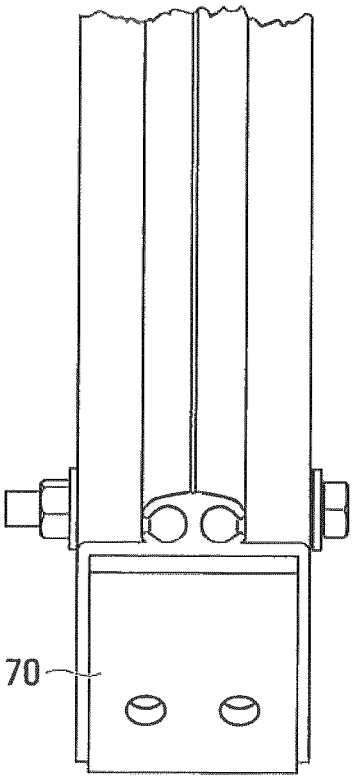
FIG. 6A is a side view of a purlin according to the invention.
Figure 6B:
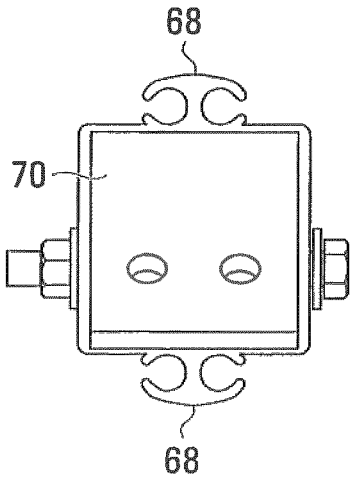
FIG. 6B is an end view of a purlin according to the invention.

In one embodiment, keder rails are formed on the sleeve 58 of the apex leg 12 and removable keder rail members 66 are attached to the base legs 14. Purlins 62 are formed with sets of two keder rails 68 on each side similar to the configuration of the beams 18 (see FIGS. 6*a* and *b*). Further, purlins 62 include attachment end element 70 configured for attaching a purlin 62 to the perforated steel square tube of the leg elements 54, 59 or holes provided on the sleeve 58. The purlins 62 may be made of the same material as the roof beam 18, or may be made with other materials such as PVC or other suitable plastic so long as the resultant purlin has sufficient physical characteristics for the particular application.

As shown in FIG. 5*b*, the gable wall fabric membranes 64 may be trapezoidal membranes and may extend to the ground and be dimensioned to close an entire side of the fabric structure. Alternatively, different sections of fabric membrane including a gable wall fabric membrane 64 and a base wall fabric membrane 72 may be utilized. The wall fabric membranes 64, 72 may have keder strips around the entirety of their periphery and have all sides including the bottom engaged in keder rails. Alternatively, fabric membranes tensioned through engagement in keder rails on legs may be left unattached at the bottom and form an aesthetic catenary or other shape on the bottom of a partial side wall as shown in FIG. 5*b*. To the extent that the gable wall fabric membranes 64 or base wall fabric membranes 72 extend to the ground, suitable means may be used to attach the fabric membrane under vertical tension. For instance, a tube or tension bar inserted into a pocket on the lower end of the wall fabric membrane 64 or 72 may be anchored by ground anchors (not shown) adapted to apply vertical tension to the fabric membrane.

One of the primary advantages of fabric structures erected and assembled according to the invention is that they are very versatile. Fabric membrane walls may be attached and tensioned easily using keder strips and keder rails. Similarly, keder rails may be attached to different types of structures including doors, windows, counters or other accessories that may be separately supported on the ground or supported through attachment of keder strips and keder rails on structural or other elements of the fabric structure. Further, assembling and maintaining fabric membranes in tension is facilitated by modular design whereby the fabric membranes are dimensioned to fit under appropriate tension when attached to keder rails attached to elements of the support structure 10 or purlins 62 attached to said support structure.

Tensioning of fabric membranes is facilitated by providing modular members to which fabric membranes may be attached before the members are attached to the fabric structure. The ability to tension and maintain tension in the fabric membranes assists with the aesthetic appeal of the fabric structures. Further, the generally vertical walls provide suitable substrates for printed logos or other ornamentation.

The provision of modular purlins 62 that may be added at various positions between any of the legs 12, 14 or beams and may have fabric membranes attached to keder rails on said purlins 62 prior to attachment, provides flexibility for adding stability and adding tensioned fabric walls, including interior walls, to the fabric structure. In one embodiment, the beams 18 and purlins 62 are all approximately the same length such that any beam 18 or purlin 62 may be attached between any two apex or base legs 12,14.

Further, the versatility of fabric structures according to the invention is enhanced by providing attachment points for cables or stays on legs, connectors, beams or purlins providing for connection between said attachment points and from said attachment points to ground or exterior anchor points.

Another preferred aspect of the invention is realized when the apex legs 12 and the base legs 14 all telescope. In that case, after the trapezoidal support structure 10 is erected and the upper portions of the fabric structure are assembled, the top portions of the trapezoid support structure with fabric roof 60, gable walls 64, etc. attached may be telescopically raised on all four legs. The ability to do so facilitates most if not all of the work involved in assembling the fabric structure being undertaken without the need for ladders, scaffolding, etc.

Figure 7:
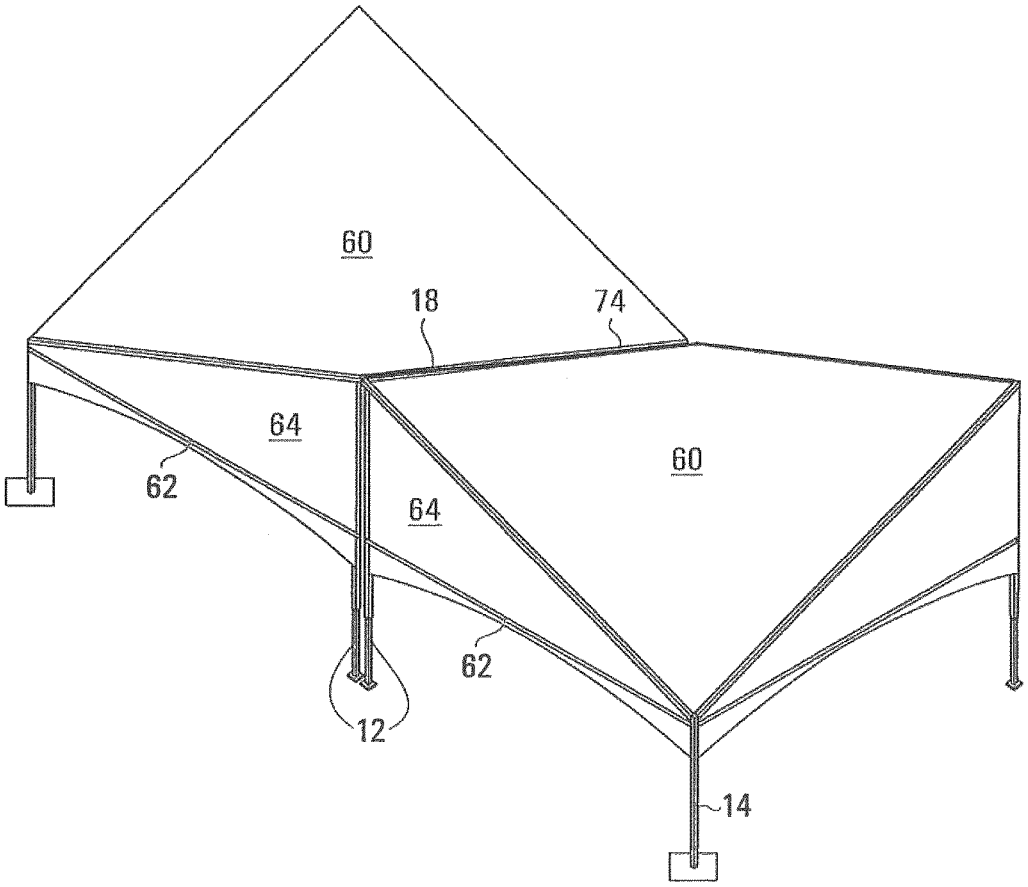
FIG. 7 is a perspective view of two fabric structures according to the invention joined together.

Another aspect of the modularity of the fabric structures of the present invention is that the structures may easily be joined together. For instance, in the embodiment shown in FIG. 7, two fabric structures according to the invention are positioned with respective apex leg 12, base leg 14 and beam 18 positioned adjacent to each other. A keder connecting membrane 74 comprising two keder strips joined by a membrane, that may be fabric or a suitable plastic such as PVC, is slid into corresponding keder rails on each of the beams 18. Similarly, keder connector membranes may be slid into keder rails on the respective apex legs 12 and base legs 14 (not shown). In that way, it is possible to form closed fabric structures comprising two or more fabric structures of the invention. The hyperbolic trapezoid shape of the roof of the structure results in effective drainage off the roof for any combination of pairs of fabric structures according to the invention. In other words, a structure may be assembled that is two structures wide and as long as desired. To the extent that wider structures are desired, means are required to facilitate drainage from low points on the roof of the combined structure.

Figure 8:
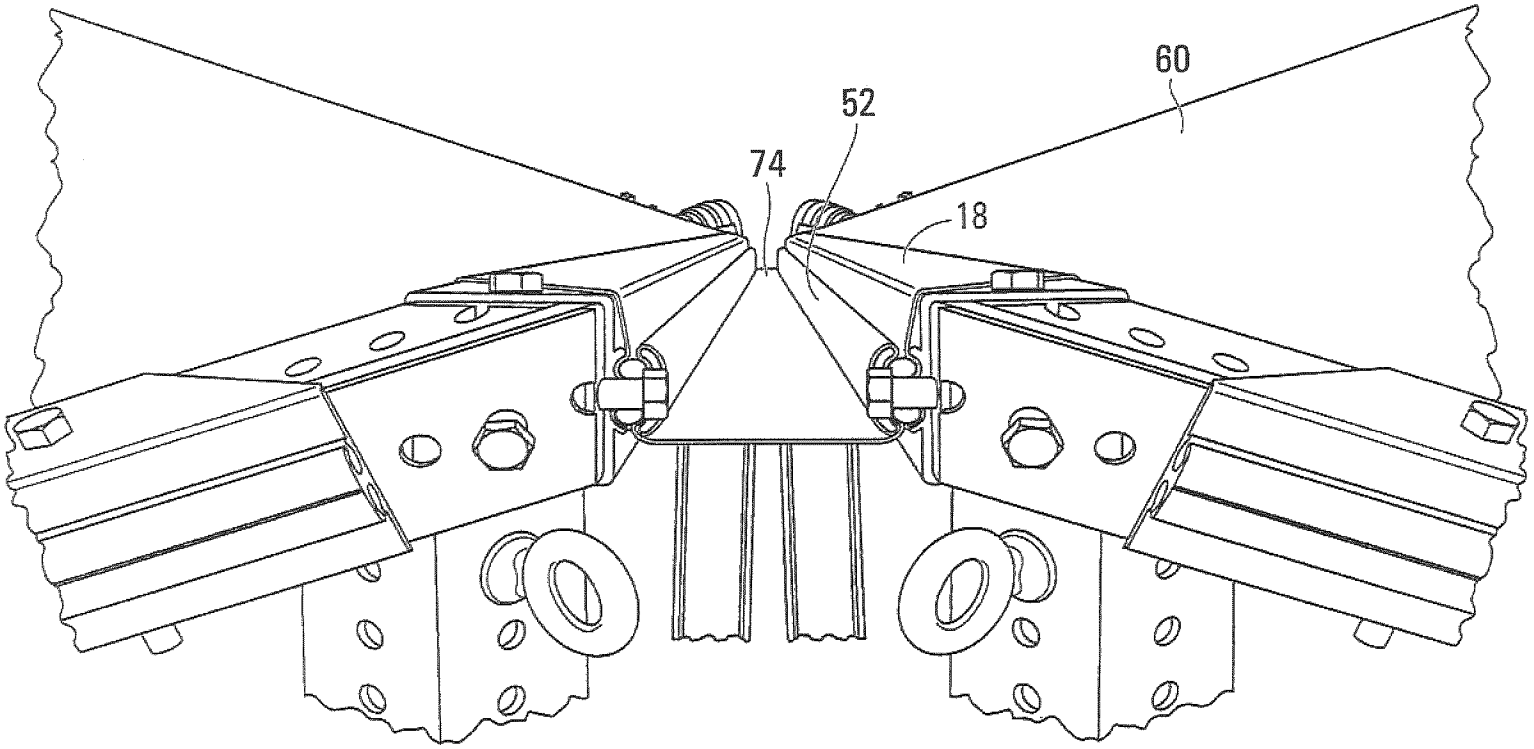
FIG. 8 is a close up perspective view of a method of joining fabric structures according to the invention.

As will be seen from FIG. 8, use of the embodiment of the beams 18 shown in FIG. 4 and described above facilitates attachment of keder strips on the roof fabric membrane 60 and keder connecting membrane 74. Gable wall fabric members may be attached to one of the keder rails 52 on the other side of the beam 18 with one keder rail still available that may be used for, for instance, receiving keder strips on a fabric ceiling, interior decorations or other accessories.

Those skilled in the art will understand that the above detailed description is by way of example only. Modifications may be made to the subject matter described within the scope of the invention as defined in the claims.

I claim:

1. A fabric structure comprising:

a) Two telescoping apex legs each having a bottom end that supports said leg on the ground and a top end having an apex connector for connection of the leg to two beams;

b) Two generally vertical base legs each having a bottom end attached to a base that supports the leg on the ground, the base being adapted to resist upward force on the base leg by its mass, added mass or being anchored to the ground, and a top end having a base connector for connection of the base leg to two beams;

c) Four roof beams each having a first end attached to one of said apex connectors and a second end attached to one of said base connectors to form a support structure;

d) A roof fabric membrane connected to each of said roof beams along a substantial portion of its periphery, and dimensioned to be held under tension when connected to all of said roof beams; and e) Said roof beams being sufficiently rigid and said apex and base connectors being configured such that, when said apex connectors are telescopically raised relative to said base connectors and said apex legs are positioned and maintained generally vertically, a moment is applied to said roof beams tending to bow them upward and outward.

2. The fabric structure of claim 1 wherein said base connectors form a hinged connection with said roof beams.

3. The fabric structure of claim 1 wherein said apex connectors form a hinged connection with said roof beams.

4. The fabric structure of claim 1 wherein said base legs are telescoping legs.

5. The fabric structure of claim 1 wherein said roof beams have roof keder rails and said roof fabric membrane has keder strips around a substantial portion of its periphery slidingly received in said roof keder rails.

6. The fabric structure of claim 1 wherein one or more of said roof beams has a wall keder rail and further including a wall fabric membrane dimensioned to be attached to said wall keder rail by keder strips along a top thereof.

7. The fabric structure of claim 6 wherein at least one of said apex legs and base legs has a keder rail for receiving a keder strip on a side of said wall fabric membrane.

8. The fabric structure of claim 1 further including a purlin configured to be attached between said apex legs or base legs.

9. The fabric structure of claim 8 wherein said purlin has a keder rail for receiving a keder strip on a wall fabric membrane to form a fabric gable wall held under tension.

10. The fabric structure of claim 8 wherein one or more of said legs, beams or purlin include a sleeve configured to slide over and be releasably fixed at a selected position on perforated tube forming part of the leg, beam, purlin or one of said connectors.

11. The fabric structure of claim 10 wherein keder rails are formed on said sleeves.

12. The fabric structure of claim 9 wherein one or more of said legs is formed of telescoping perforated tube and one or more of said purlins is configured to be releasably fixed generally perpendicular to said perforated tube at different positions on said perforated tube.

13. A fabric structure including more than one fabric structure of claim 9, said fabric structure comprising a first structure being attached to a second structure along a substantial portion of adjacent roof beams with respective apex legs and base legs aligned.

14. The fabric structure of claim 13 wherein each fabric structure is joined to an adjacent fabric structure along a substantial portion of adjacent apex legs and base legs.

15. The fabric structure of claim 14 wherein adjacent fabric structures are attached using keder strips on membranes inserted into keder rails on adjacent roof beams, apex legs or base legs.

16. The fabric structure of claim 1 further including a cable attached between said base connectors.

17. The fabric structure of claim 6 wherein said wall fabric membrane is a triangle or trapezoid that is held in said keder rail along a substantial portion of its periphery to form a closed tensioned gable wall.

18. The fabric structure of claim 5 further including a purlin configured to be attached in said support structure and having a keder rail for receiving a keder strip on a divider wall fabric membrane to provide an interior divider wall.

19. A method of erecting the fabric structure of claim 1 comprising the steps of:

a) attaching said roof fabric membrane to said beams by sliding keder strips on the periphery of said roof fabric membrane into, keder rails on said beams;

b) attaching said beams to said connectors;

c) telescopically raising said apex connectors relative to said base connectors and adjusting the position of said apex legs to form the support structure with a tensioned hyperbolic fabric roof on said generally vertical legs; and attaching wall fabric membranes to said support structure by sliding keder strips on the periphery of said wall fabric membranes into keder rails on said beams, legs and on purlins that releasably attach to the support structure.

* * * * *